US006223378B1

(12) United States Patent
Watellier

(10) Patent No.: US 6,223,378 B1
(45) Date of Patent: May 1, 2001

(54) DEVICE FOR APPLYING A SHEET MATERIAL ON A SURFACE SUCH AS A FLOOR

(75) Inventor: Christian Watellier, Beuvry (FR)

(73) Assignee: Beuvry Nov, SARL, Beuvry (FR)

( * ) Notice: Subject to any disclaimer, the term of this patent is extended or adjusted under 35 U.S.C. 154(b) by 0 days.

(21) Appl. No.: 09/297,184

(22) PCT Filed: Oct. 23, 1997

(86) PCT No.: PCT/FR97/01895

§ 371 Date: Jul. 22, 1999

§ 102(e) Date: Jul. 22, 1999

(87) PCT Pub. No.: WO98/18380

PCT Pub. Date: May 7, 1998

(30) Foreign Application Priority Data

Oct. 25, 1996 (FR) ..... 96 13283

(51) Int. Cl.[7] ..... A47L 13/20
(52) U.S. Cl. ..... 15/103.5; 15/98; 15/231
(58) Field of Search ..... 13/98, 99, 103.5, 13/231, 228

(56) References Cited

U.S. PATENT DOCUMENTS

| | | | | |
|---|---|---|---|---|
| 2,601,537 | | 6/1952 | Lofgren | 15/114 |
| 2,828,501 | | 4/1958 | Brown, Sr. | 15/114 |
| 3,150,407 | * | 9/1964 | Mitchell | 15/98 |
| 3,945,078 | * | 3/1976 | Acquaro | 15/99 |
| 4,246,674 | * | 1/1981 | Ingermann et al. | 15/98 |
| 4,433,451 | * | 2/1984 | Parisi | 15/231 |
| 4,510,642 | * | 4/1985 | Ingermann et al. | 15/99 |
| 4,550,467 | | 11/1985 | Johnson et al. | 15/228 |
| 4,562,610 | | 1/1986 | Davis et al. | 15/228 |
| 5,327,609 | * | 7/1994 | Bierma et al. | 15/98 |
| 5,993,900 | * | 8/1999 | Wang | 15/99 |

FOREIGN PATENT DOCUMENTS

| | | |
|---|---|---|
| 3500036 | 7/1985 | (DE) . |
| 2736533 | 1/1997 | (FR) . |
| 609981 | 10/1948 | (GB) . |

* cited by examiner

*Primary Examiner*—Terrence R. Till
(74) *Attorney, Agent, or Firm*—Miles & Stockbridge P.C.; Dennis P. Clarke

(57) ABSTRACT

The invention relates to a device (1) for applying to a floor (2) a sheet material drawn from a reel (5) of a strip (6), which device comprises a frame (7) and two rollers (8, 9) guided in rotation on the frame around parallel axes, on which a strip (6) of material (4) is disposed so that a generator of each roller is selectively placed in contact with the floor (2) by an application means during the utilization of the device (1) in a back-and-forth movement; a handle (3) articulated to the frame (7) around an axis (3A) parallel to the axes of the rollers; a means for controlling the feeding of the strip (6) so as to ensure the replenishment of the material placed in contact with the floor (2) and the winding of the soiled strip (6) onto a receiving mandrel (12).

8 Claims, 6 Drawing Sheets

DEVICE FOR APPLYING A SHEET MATERIAL ON A SURFACE SUCH AS A FLOOR

BACKGROUND OF THE INVENTION

1. Field of the Invention

The invention relates to a device for applying a sheet material onto a surface such as a floor.

The invention relates more particularly, though not exclusively, to a device having an advantageous application to the cleaning of a floor.

The invention relates to a device for cleaning a floor, of the type which is moved by a person, in front of himself, by means of a control handle, and which places in contact with the floor a sheet material drawn from a reel of a strip of cleaning material of this type.

In addition to a frame, a cleaning device of this type comprises:

- two cylindrical rollers, called nose and heel rollers, guided in rotation on the frame around approximately parallel axes, on which a strip of cleaning material is disposed and held taut so that at least one generator of each roller carrying this sheet can be selectively placed in contact with the floor by an application means during the utilization of the device in a back-and-forth movement,
- a control handle articulated to the frame around an axis substantially parallel to the axes of the rollers,
- a means for controlling the feeding of the strip so as to ensure the replenishment of the material placed in contact with the floor.

2. Description of the Prior Art

Devices of this type are described for example in the documents U.S. Pat. No. 4,562,610 and U.S. Pat. No. 4,510,642.

These devices of the prior art have their advantages, but they comprise a means for controlling the feeding of the strip of the type that makes use of a friction component on the floor.

The operation of this type of feeding means cannot be guaranteed when the floor to be cleaned has been made slick by cleaning agents.

SUMMARY OF THE INVENTION

One object of the invention is to obtain a cleaning device comprising an autonomous means for controlling the feeding of the cleaning strip that is reliable, and whose operation is not dependent on a coefficient of friction between the floor and a mechanism that receives a movement from said floor when the device is moved.

Another object of the invention is to obtain a cleaning device in which the replacement of a soiled strip is fast and trouble-free.

Another object of the invention is to obtain a device that makes it possible to apply a maintenance product to the floor, such as a liquid cleaning agent, a wax or the like.

To this end, the subject of the invention is a device of the above-mentioned type, characterized in that:

- the axis of articulation of the handle on the frame is disposed behind the heel roller, and
- the application means comprises:
  - an element for support on the floor, which is movable relative to the frame between two positions, including a first position in which it removes the heel roller from contact with the floor while inducing the application of the nose roller to the floor, and a second position in which, conversely, it removes the nose roller from contact with the floor while inducing the application of the heel roller to the floor, and
  - an elastic element at least indirectly disposed between the element for support on the floor and the frame, so as to stress this element for support on the floor toward its so-called first position.

The invention will be clearly understood with the aid of the following description, given as a non-limiting example with reference to the attached drawing, which schematically represents:

DETAILED DESCRIPTION OF THE INVENTION

Figure 1:
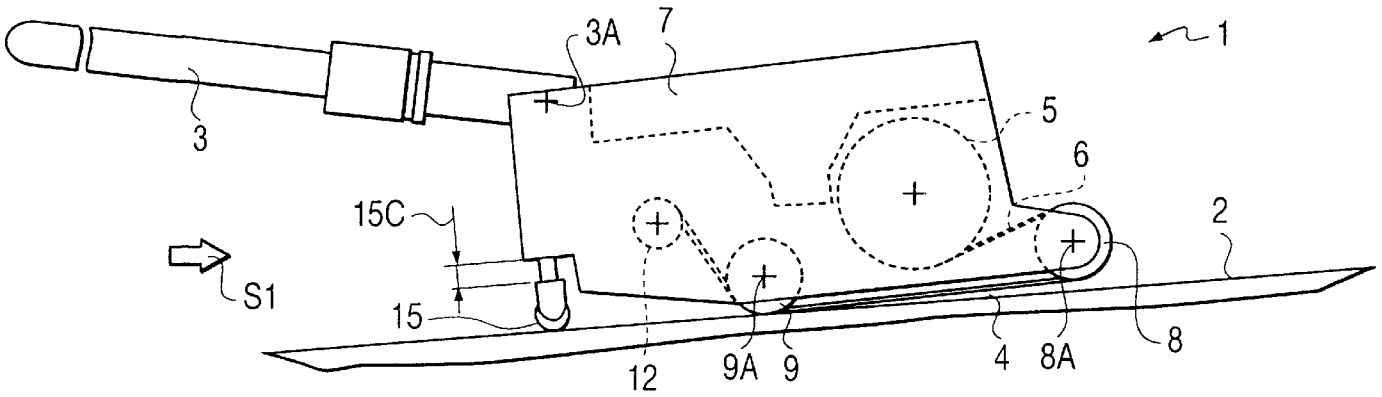
FIGS. 1 and 2: two simplified lateral views of the device of the invention during use.

The drawing shows a device 1 for applying a strip 6 of material 4 to a surface 2 such as a floor.

The term "floor" is used hereinafter to designate any surface to which the device can be applied.

By way of example, the device of the invention is described as a device for cleaning a floor 2, of the type which is moved by a person (not represented), in front of himself, by means of a control handle 3, and which places in contact with the floor 2 a sheet material 4 drawn from a reel 5 of a strip 6 of cleaning material of this type [in strip form] 6.

In addition to a frame 7, a cleaning device of this type comprises:

- two cylindrical rollers 8, 9, called nose (8) and heel (9) rollers, guided in rotation on the frame around approximately parallel axes 8A, 9A, on which a strip 6 of cleaning material 4 is disposed and held taut so that at least one generator 8B, 9B of each roller 8, 9 carrying this sheet 4 can be selectively placed in contact with the floor 2 by an application means (10) during the utilization of the device 1 in a back-and-forth movement in a direction approximately perpendicular to said rollers,
- a control handle 3 articulated on the frame 7 around an axis 3A substantially parallel to the axes 8A, 9A of the rollers 8, 9, and
- a means 11 for controlling the feeding of the strip 6 so as to ensure the replenishment of the material placed in contact with the floor 2 and the winding of the soiled strip 6 onto a receiving mandrel 12.

The term heel roller 9 designates the one of the rollers 8, 9 that is located at the rear part of the device 1, that is, the one that is closest to the person who moves said device 1.

Thus, the term nose roller 8 designates the one of the rollers 8, 9 which, conversely, is the farthest away from the person who moves the device 1.

In a remarkable way:

- the axis 3A of articulation of the handle 3 on the frame 7 is disposed behind the heel roller 9, and the application means 10 comprises:

an element 15 for support on the floor 2, which is movable relative to the frame 7 between two positions 15B, 15C, including a first position 15B in which it removes the heel roller 9 from contact with the floor 2 while inducing the application of the nose roller 8 to the floor 2, and a second position 15C in which, conversely, it removes the nose roller 8 from contact with the floor 2 while inducing the application of the heel roller 9 to the floor 2, and an elastic element 16 at least indirectly disposed between the element 15 for support on the floor 2 and the frame 7, so as to stress this element 15 for support on the floor 2 toward its so-called first position 15B.

Preferably, the application means is elastically notched, i.e., it comprises elements (not represented) that tend to elastically retain the element 15 for support on the floor in at least one of its extreme positions.

Advantageously, the element 15 for support on the floor is comprised of a wheel 15.

Remarkably, the device comprises an elastic part 14, carried at least indirectly by the frame, for cooperating with another stop carried by the handle 3, these stops being oriented and disposed so that when the handle 3 is lifted, i.e., when the device 1 is pulled backward S2, they induce, if necessary, the application of the nose roller 8 to said floor 2.

Preferably, the elastic part 14 is comprised of a flexion spring.

These technical characteristics make it so that when a person moves the device 1 in front of himself, imparting to it an alternating forward (S1) and backward (S2) movement:

during the forward movement, the heel roller 9 comes into contact with the floor 2 while the nose roller 8 moves away from said floor, whereas during the backward movement, the order of the rollers 8, 9 in contact with the floor is reversed, i.e., the nose roller 8 comes into contact with said floor 2, while the heel roller 9 moves away from the floor 2.

Remarkably, the means 11 for controlling the feeding of the strip 6 comprises an element 17 disposed so as receive an alternating movement from a moving element 18 at least indirectly associated with the element 15 for support on the floor 2, and so as to drive, at least indirectly in rotation by a fraction of a turn, via an element 19A through 19E, at least the mandrel 12 for receiving the soiled strip, in a direction such that said strip 6 is moved, by a fraction of the distance that separates the nose roller 8 and the heel roller 9, from said nose roller 8 toward said heel roller 9.

Figure 2:
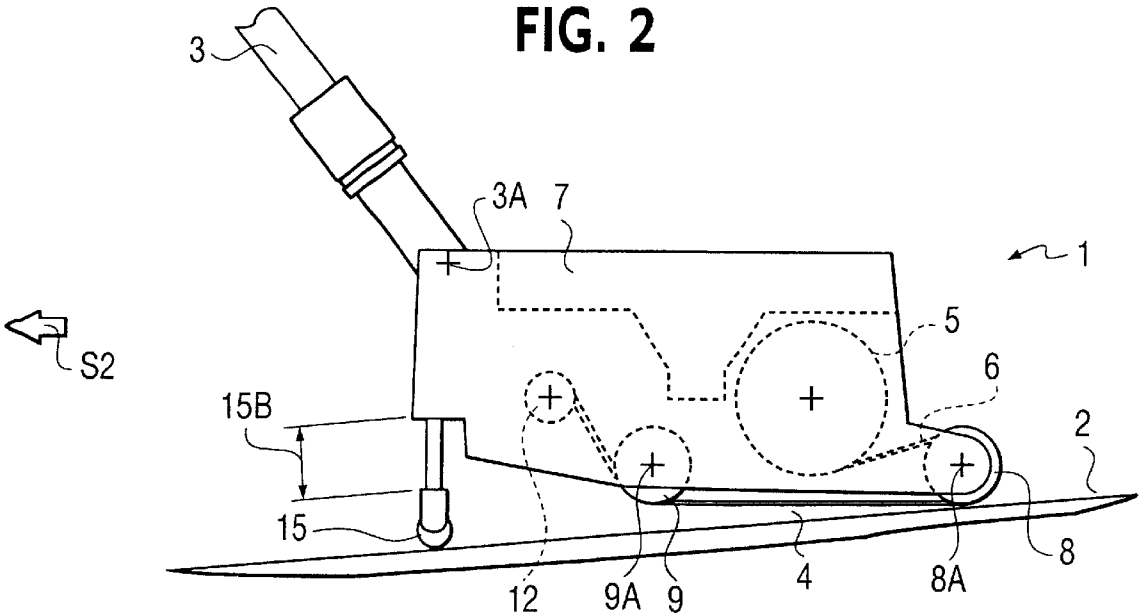
Figure 3:
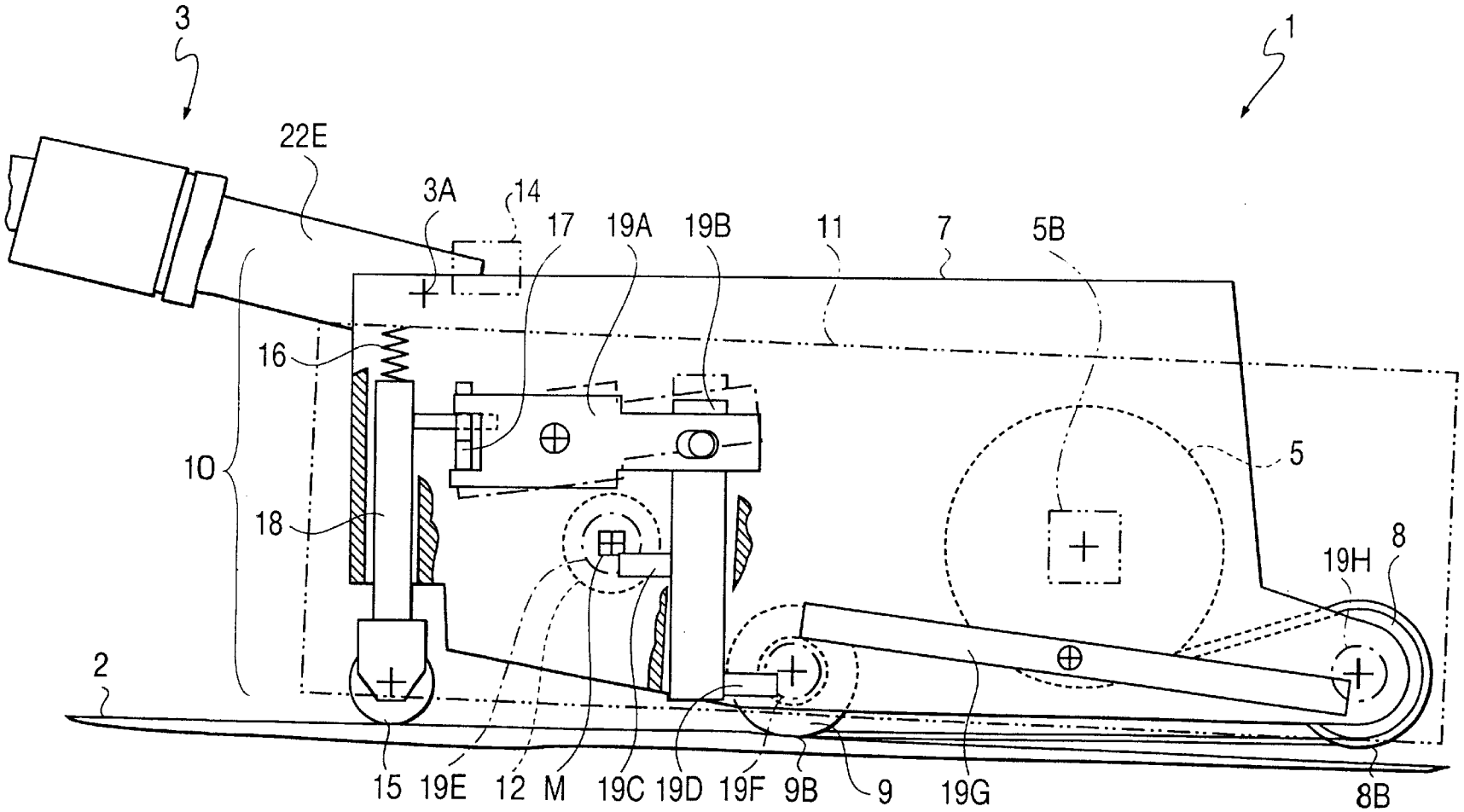
FIGS. 3 and 4: at a larger scale, two sectional views of the device of the invention in two different planes.
Figure 4:
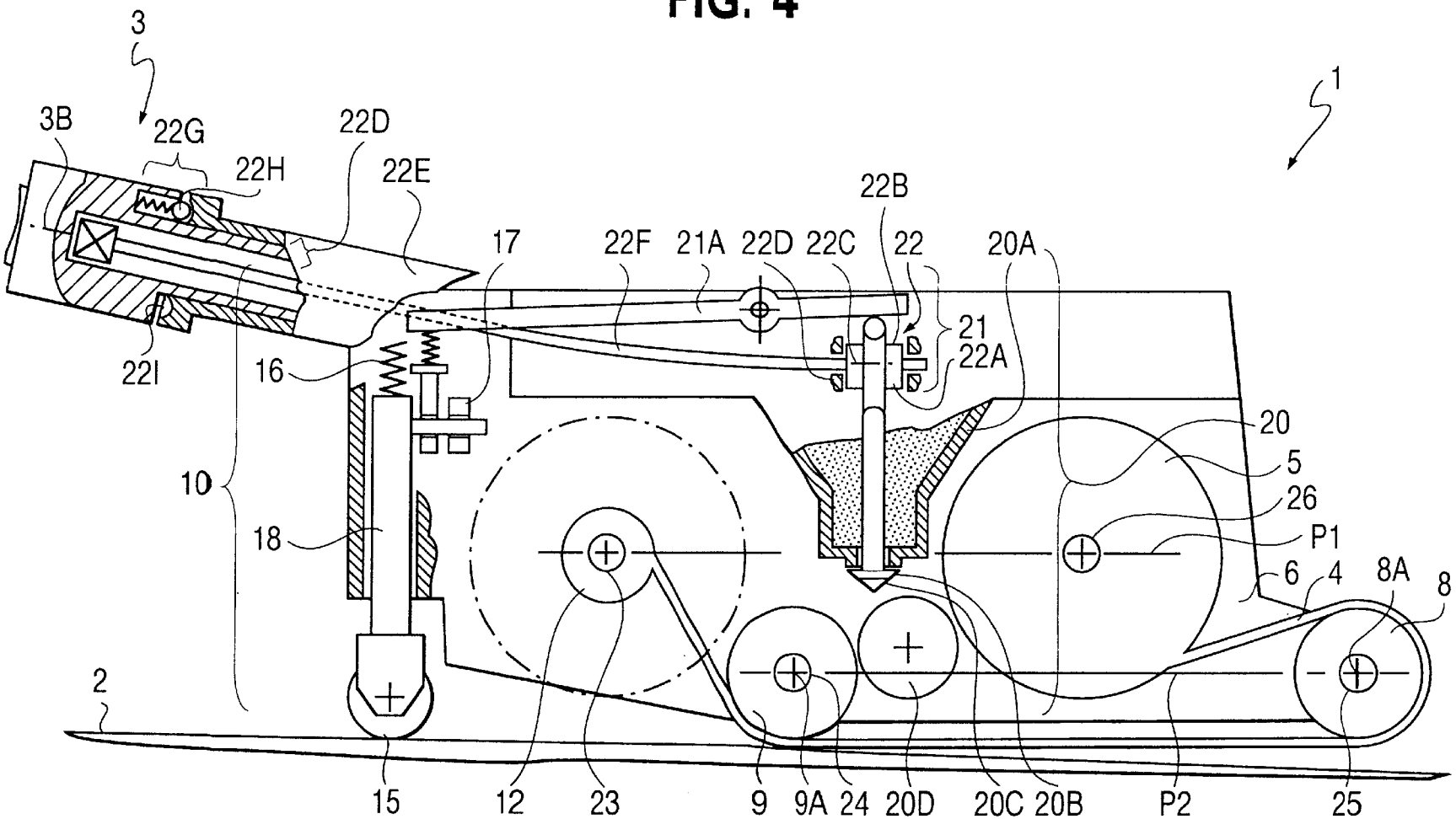

These characteristics make it so that when the device 1 is drawn backward on the floor 2, the nose roller 8 places in contact with the floor 2, a generator equipped with an unsoiled strip 6 (FIG. 2).

This makes it possible for a surface against which the strip has just been moved to be wiped clean.

Preferably, in the means 11 for controlling the feeding of the strip, the element 17 for receiving an alternating movement from an element 18 associated with the element 15 for support on the floor 2, and for driving in rotation an element 19E for controlling the rotation of the mandrel 12 for receiving the strip 6, cooperates at least indirectly with an element 19F for driving the heel roller 9 in rotation.

This makes it possible to guarantee a better feeding of the strip 6.

Notably, the heel and nose rollers are coated with a flexible sticky material such as a foam, which enables the strip to cling to them.

These characteristics also enable the strip to better conform to irregularities in the floor 2.

Equally remarkably, in the means 11 for controlling the feeding of the strip, the element 17 for receiving an alternating movement from an element 18 associated with the element 15 for support on the floor 2, and for driving in rotation the element 19E for controlling the rotation of the mandrel 12 for receiving the strip 6, cooperates at least indirectly, particularly via an element 19G, with an element 19H disposed so as to cooperate with at least one of two elements, i.e., the nose roller 8 and the strip reel 5, and to alternate cause their rotational immobilization and release in sync with the control of the fractional forward movement of the strip 6.

Hence the nose roller 8 is only free to rotate when the mandrel 12 and the heel roller 9 are driven in rotation.

Advantageously, the device 1 comprises a means 5B for braking the rotation of the reel 5 of material in strip form 6.

Preferably, the means 11 for controlling the feeding of the strip comprises at least:

an elongated part called a slider 18, guided in translation on the frame 7 in a direction approximately perpendicular to the floor, which carries the element 15 for support on the floor 2 at one of its ends and which receives, at the other end, the action of the elastic element 16 for stressing said element 15 for support on the floor 2 toward its so-called first position 15B, wheels 19E, 19F with ratchets 19C, 19D, each at least indirectly linked to the mandrel 12 for receiving the soiled strip and to the heel roller 9 so as to drive, during their own rotation, these rollers 8, 9, an element 17 called a control lever, which is articulated to the frame 7 and disposed so as to receive an alternating movement from the slider 18, and via a lever 19A articulated to the frame 7, to move a pusher 19B guided in translation on said frame 7 and carrying the ratchets 19C, 19D for cooperating with the wheels 19E, 19F for this purpose, a wheel 19H at least indirectly linked rotationally to the nose roller 8, for rotationally immobilizing, during its rotational immobilization, said nose roller 8, an element 19G articulated on the frame, for cooperating at least indirectly with the control lever 17 and the wheel associated with the nose roller, so as to alternately, and in sync with the control of the fractional feeding of the strip 6, rotationally immobilize the nose roller 8 and release this roller 8.

Preferably, the element 17 called the control lever receives the movement from the slider 18 by means of a pin 18A.

As shown in the drawing, the device comprises a means 20 for irrigating the fraction of the strip 6 disposed between the heel roller 9 and the nose roller 8, which means 20 itself comprises a reservoir 20A of liquid equipped with at least one outlet 20B for the evacuation of liquid to said fraction of the strip 6, each outlet 20B being disposed approximately directly above the strip 6 and being provided with an element 20C for controlling the flow of liquid.

Although it is not represented, the control element 20C is elastically stressed into the closed position by an element for this purpose.

Notably, the axes of rotation 12A, 5A of the mandrel 12 for receiving the soiled strip and of the reel 5 of the strip 6 are contained in a plane P1 located above a plane P2 that contains the axes of rotation 8A, 9A of the nose 8 and heel 9 rollers, and are offset relative to said axes 8A, 9A so that the reel 5 of material in strip form can be at least partially housed between the nose 8 and heel 9 rollers.

Equally remarkably, the reservoir 20A has a lower wall shaped so that, without contact with the strip 6, it at least partially covers the cylindrical shapes of the reel 5 and of the mandrel 12 when they are loaded with a strip 6.

These technical characteristics make it possible to reduce the total height of the device.

Remarkably, the device 1 comprises:

a means 21 for alternately controlling the element 20C for controlling the flow of liquid issued from the reservoir 20A, between a closed position and an open position, which means 21 itself comprises at least one element 21A for receiving at least indirectly a control movement from the control handle 3 of the device 1, a means 22 for adjusting the value of the opening of the element 20C for controlling the flow of liquid.

The means 21 for alternately controlling the flow control element 20C comprises at least one element 21A, such as a lever, for receiving the movement from the slider 18 and for applying this movement at least indirectly to said flow control element 20C so that the irrigation of the strip takes place while the heel roller is in contact with the floor.

The adjusting means 22 is advantageously comprised of a means for adjustment by rotating the handle.

Precisely, the means 22 for adjusting the value of the opening of the control element 20C comprises:

a rotating cam 22A having a cam path 22B formed by a surface disposed so as to oppose the movement of the flow control element 20C in a way that is adjustable as a function of the orientation of the cam 22A around an axis of rotation 22C, a means 22D for guiding a rotating part of the handle 3 in rotation on the longitudinal axis 3B of said handle relative to a supporting part 22E that is articulated on the frame 7 on the axis of articulation 3A of the handle 3, a flexible element 22A for rotationally linking the rotating part of the handle 3 and of the cam 22A.

In one remarkable embodiment, the means 20 for irrigating the strip 6 comprises at least one element 20D, 9 for distributing the liquid across the width of the strip.

Advantageously the element 20D consists of a roller disposed so as to collect the liquid released from the reservoir and apply it to the heel roller 9.

Advantageously, interposed between the articulating part 22E of the handle 3 on the frame 7 and the handle 3 is a rotational indexing means 22G.

For example, this indexing means 22G comprises an index 22H, such as a ball, carried by one of two elements, i.e., the articulating part 22E or the handle 3, and a notched surface 22I carried by the other of said elements.

The frame 7 of the device 1 comprises means 23 through 27 for rotationally guiding:

cylindrical rollers 8, 9, called the nose (8) and heel (9) rollers, around approximately parallel axes 8A, 9A, the mandrel 12 for winding the soiled strip, the reel 5 of the strip 6 of cleaning material in strip form.

These means conventionally comprise rotating cylindrical bearing surfaces.

Figure 5:
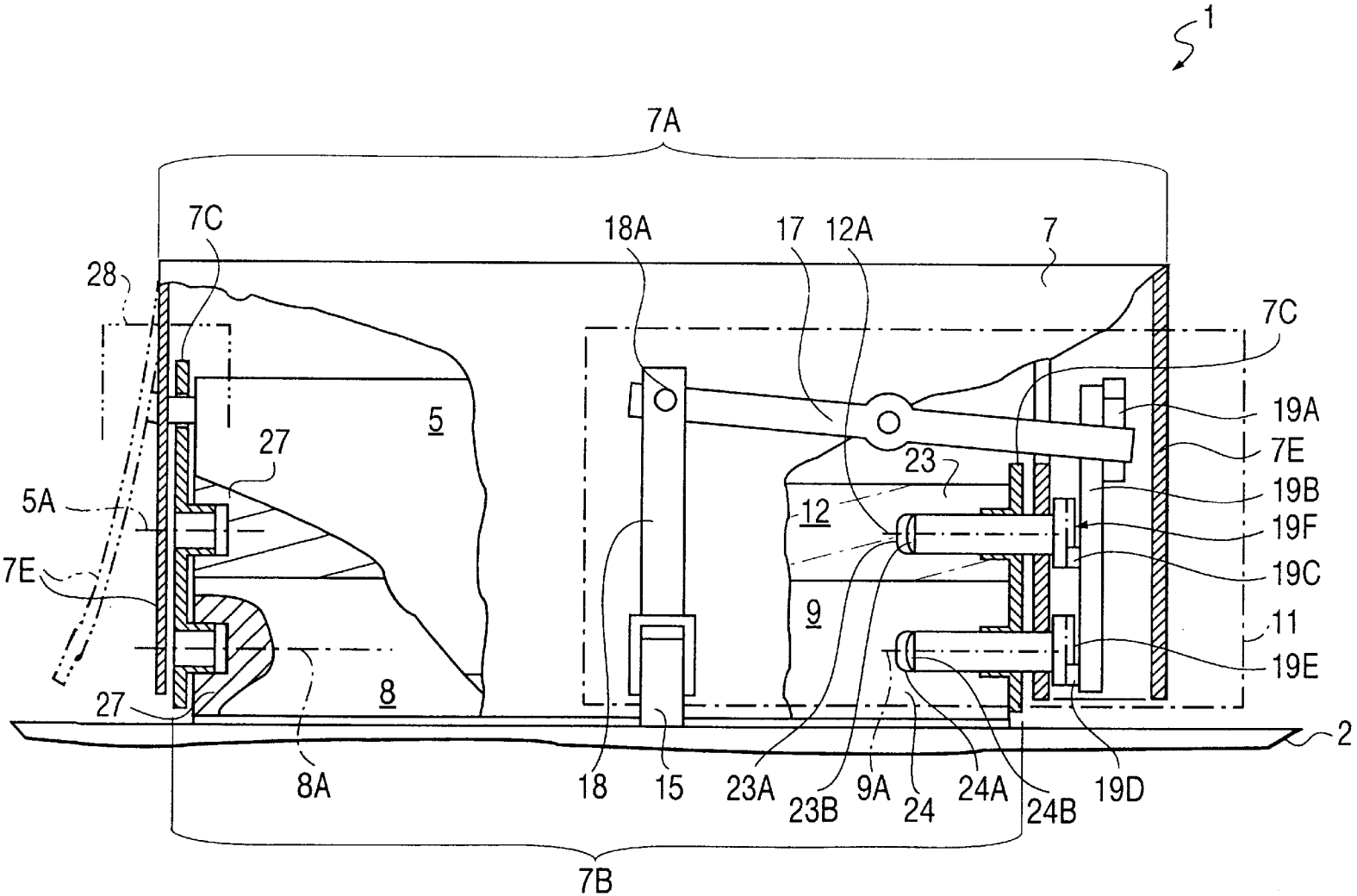
FIG. 5: a partial sectional view of the device seen from the rear.
Figure 6:
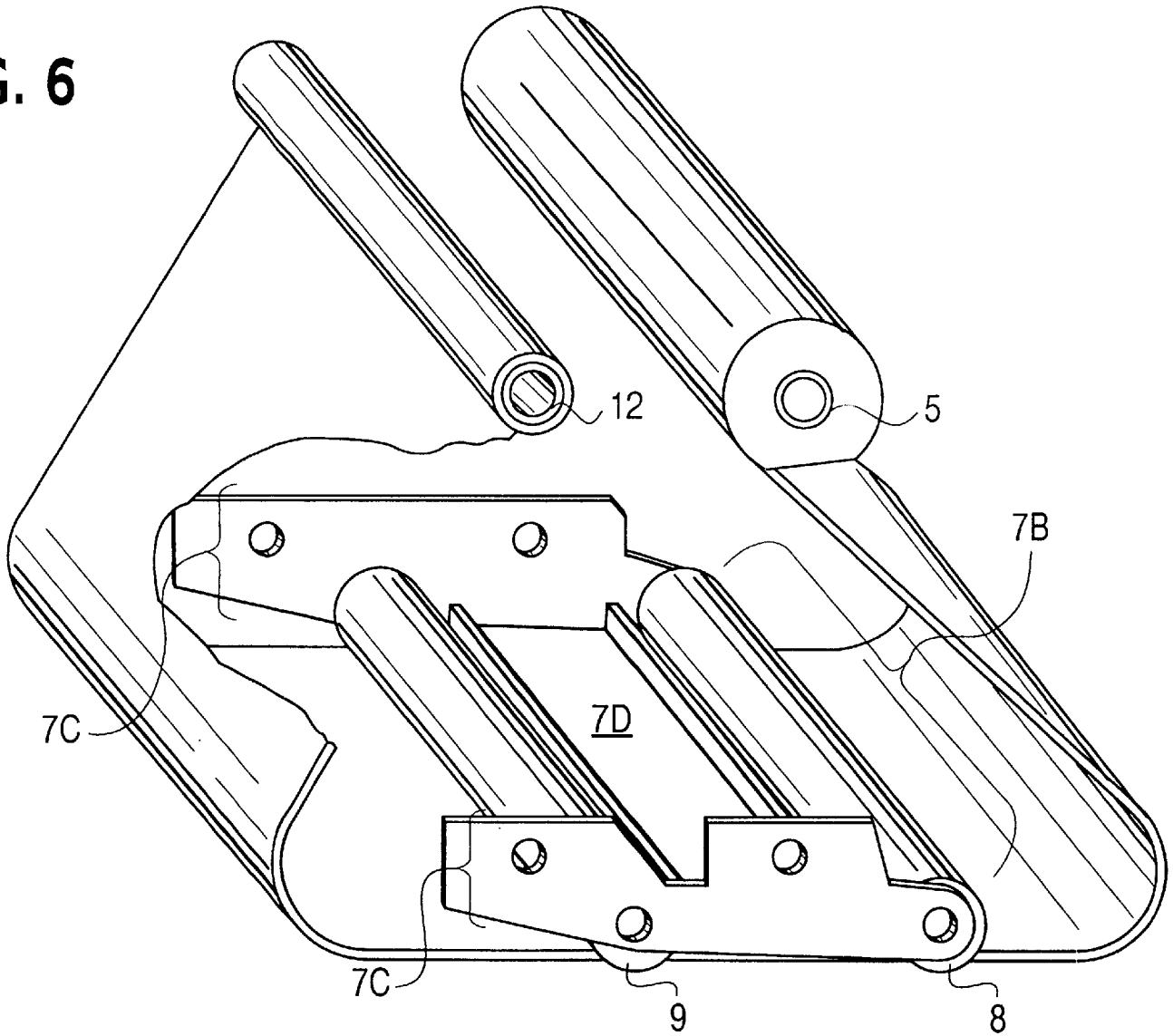
FIG. 6: a view in perspective of a part of the device of the invention.
Figure 7:
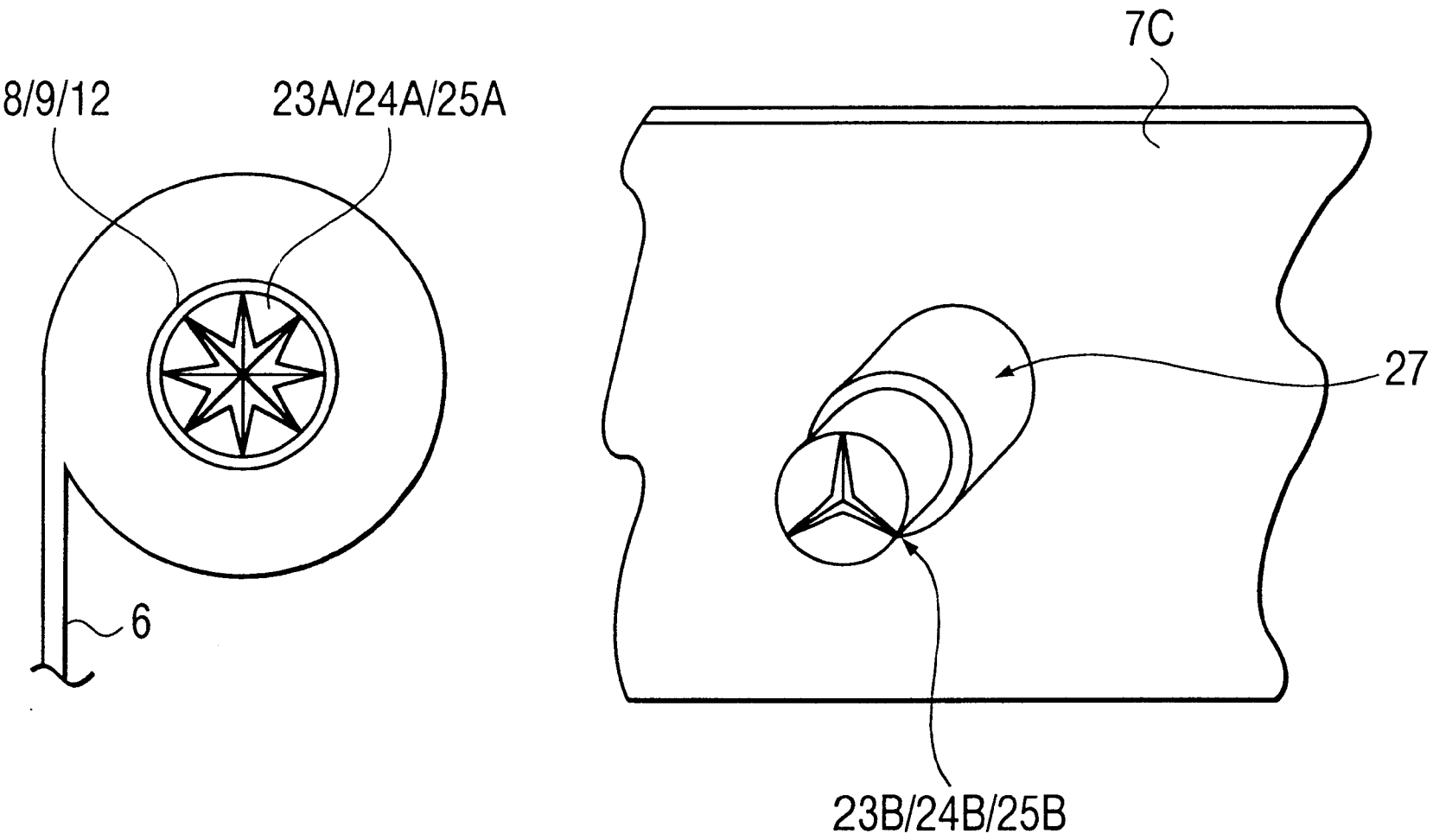
FIG. 7: longitudinal sectional views of two detachable complementary coupling elements.

Remarkably:

the frame 7 of the device 1 comprises two distinct parts 7A, 7B, which cooperate via a detachable joining means 28, which parts 7A, 7B are a first part 7A, on which the handle 3 is articulated, and which carries the irrigating means 20 as well as the means 11 for controlling the feeding of the strip 6, a second part 7B, which at least indirectly carries the means 23 through 26 for rotationally guiding the rotating elements that are the cylindrical nose 8 and heel 9 rollers, the mandrel 12 for winding the soiled strip, and the reel 5 for the strip 6 of cleaning material, the means 11 for controlling the feeding of the strip 6 and the various rotating elements comprise detachable complementary coupling elements 23A, 23B, 24A, 24B, 25A, 25B (FIGS. 5 and 7).

Advantageously, but in a non-limiting way, the detachable coupling means (23A, 23B, 24A, 24B, 25A, 25B) are constituted by notched surfaces constituting claws.

Notably, a clutching means M is interposed between the element 19E for rotationally driving the mandrel and the means for rotationally coupling this element and said mandrel.

This clutching means M makes it possible to compensate for the peripheral speed differences between the heel roller 9 and the mandrel 12.

Preferably, and remarkably:

the second part 7B of the frame 7 comprises two flanges 7C between which extend the heel (9) and nose (8) rollers and which, being held in approximately parallel planes by a crosspiece 7D, carry means 23 through 26 for rotationally guiding the ends of said rollers 8, 9, the ends of the mandrel 12 for winding the soiled strip 6, and the reel 5 of the strip 6 of cleaning material in strip form 6, the first part 7A of the frame 7 has two cheeks 7E, each intended to cooperate with one of the flanges 7C of said second part 7B, which carry elements and components of the means 11 for controlling the feeding of the strip 6, including detachable elements 23A, 24A, 25A for coupling with complementary elements 23B, 24B, 25B carried by at least certain ends of the rollers 8, 9, of the mandrel 12 for winding the soiled strip, and of the reel 5 of the strip 6 of cleaning material in strip form.

Advantageously, the crosspiece 7D for holding the flanges 7C extends in a plane approximately tangent to the generators 8B, 9B of the nose 8 and heel 9 rollers for placing the strip 6 in contact with the floor 2.

The second part 7B of the frame 7 carries the mandrel 12 for winding the soiled strip 6 and the reel 5 of the strip 6 of cleaning material in strip form by means of rotational guiding means 27 of a removable type.

Thus, once the second part 7B of the frame 7 is removed, the mandrel 12 for winding the soiled strip 6 and the reel 5 of the strip 6 of cleaning material in strip form 6 can be removed in order to be replaced by a set that includes a clean strip.

The second part 7B of the frame can also be comprised of a single-use cartridge.

In order to constitute the means 28 for detachably joining the first (7A) and second (7B) part of the frame 7:

at least one of the cheeks 7E of the first part 7A of the frame 7 is at least locally flexible in a plane approximately parallel to the plane P1, P2 containing the axes of the rotating elements 5, 8, 9, 12 carried by the second part of the frame, and both the flanges 7C of the second part 7B and the cheeks 7E of the first part are equipped with complementary projections and depressions, which are disposed so as to cooperate during the return to position of each cheek elastically deformed for the mounting of the second part of the frame.

In a preferred embodiment, the detachable coupling means 23A, 23B, 24A, 24B, 25A, 25B are constituted by a shaft 23B, 24B, 25B and a rotating cylindrical bore 23A, 24A, 25A, the base of the bore and the corresponding end of the shaft having notched surfaces for coupling them in rotation.

What is claimed is:

1. A device (1) for applying a sheet material to a surface (2), particularly for cleaning purposes, this device being the type which is moved by a person, in front of himself, by means of a control handle (3) and which places in contact with the floor (2) a sheet material (4) drawn from a reel (5) of a strip (6) of cleaning material in strip form (6), which device comprises a frame (7) and:

two cylindrical rollers (8, 9) called the nose (8) and heel (9) rollers, guided in rotation on the frame around approximately parallel axes (8A, 9A) and on which the strip (6) of cleaning material (4) is disposed and held taut so that at least one contact surface (8B, 9B) of each roller (8, 9) carrying this sheet (4) can be selectively placed in contact with the floor (2) by an application means (10) during the utilization of the device (1) in a back-and-forth movement oriented in a direction approximately perpendicular to said rollers, the control handle being (3) articulated to the frame (7) around an axis (3A) approximately parallel to the axes (8A, 9A) of the rollers (8, 9), a means (11) for controlling the feeding of the strip (6) so as to ensure the replenishment of the material placed in contact with the floor (2) and the winding of the soiled strip (6) onto a receiving mandrel (12), this device being characterized in that:

the axis (3A) of articulation of the handle (3) on the frame (7) is disposed behind the heel roller (9), and the application means (10) comprises:

support means (15) for support on the floor (2), movable relative to the frame (7) between two positions (15B, 15C), including a first position (15B) in which the support means removes the heel roller (9) from contact with the floor (2), while inducing the application of the nose roller (8) to the floor (2), and a second position (15C) in which, conversely, the support means removes the nose roller (8) from contact with the floor (2) while inducing the application of the heel roller (8) to the floor (2), and an elastic means (16) at least indirectly disposed between the means (15) for support on the floor (2) and the frame (7) so as to stress support means (15) for support on the floor (2) toward its so-called first position (15B), the means (11) for controlling the feeding of the strip (6) comprises means (17) disposed so as to receive an alternating movement from a moving means (18) at least indirectly associated with the support means (15) for support on the floor (2) and so as to drive, at least indirectly in rotation and by a fraction of a turn, via driving means (19A through 19E), at least the mandrel (12) for receiving the soiled strip, in a direction such that said strip (6) is moved, by a fraction of the distance that separates the nose (8) and heel (9) rollers, from said nose roller (8) toward said heel roller (9).

2. A device according to claim 1, characterized in that in the means (11) for controlling the feeding of the strip, the means (17) for receiving an alternating movement from moving means (18) cooperates at least indirectly with driving means (19F), for driving the heel roller (9) in rotation.

3. A device according to claim 1 or 2, characterized in that in the means (11) for controlling the feeding of the strip, the means (17) for receiving an alternating movement from moving means (18) cooperates at least indirectly with driving means (19H), disposed so as to cooperate with at least one of two means, the nose roller (8) and the strip reel (5), and to alternately cause their rotational immobilization and release, in sync with the control of the fractional forward movement of the strip (6).

4. A device according to claim 1, and of the type comprising a means (20) for irrigating a fraction of the strip (6) disposed between the heel (9) and nose (8) rollers, said means (20) itself comprises a reservoir (20A) of liquid equipped with at least one outlet (20B) for evacuating liquid toward said fraction of the strip (6), each outlet (20B) being disposed approximately directly above the strip (6) and being provided with means (20C) for controlling the flow of liquid, characterized in that said means (20C) for controlling the flow comprises:

a means (21) for alternately controlling the means (20C) for controlling the flow of liquid issued from the reservoir (20A), between a closed position and an open position, said means (21) for alternately controlling comprises at least one means (21A) for receiving at least indirectly a control movement from the control handle (3) of the device (1), a means (22) for adjusting the value of the opening of the means (20C) for controlling the flow of liquid.

5. A device according to claim 1 wherein the frame (7) of the device (1) comprises means (23 through 27) for rotationally guiding:

the nose (8) and heel (9) rollers, around approximately parallel (8A, 9A) axes, the mandrel (12) for winding the soiled strip, the reel (5) of the strip (6) of cleaning material in strip form, characterized in that:

the frame (7) comprises two distinct parts (7A, 7B) which cooperate via a detachable joining means (28), which parts (7A, 7B) are a first part (7A), to which the handle (3) is articulated, and which carries an irrigating means (20) as well as the means (11) for controlling the feeding of the strip (6), a second part (7B) which at least indirectly carries the means (23 through 26) for rotationally guiding the rotating means that are (8, 9), the nose (8) and heel (9) rollers, the mandrel (12) for winding the soiled strip and the reel (5) of the strip (6) of cleaning material, the means (11) for controlling the feeding of the strip (6) and the various rotating means comprise detachable complementary coupling means (23A, 23B, 24A, 24B, 25A, 25B).

6. A device according to claim 5, characterized in that:

the second part (7B) of the frame (7) comprises two flanges (7C) between which extend the heel (9) and nose (8) rollers and which, being held in approximately parallel planes by a crosspiece (7D), carry means (23 through 26) for rotationally guiding the ends of said rollers (8, 9), the ends of the mandrel (12) for winding the soiled strip (6), and the reel (5) of the strip (6) of cleaning material in strip form (6), the first part (7A) of the frame (7) has two cheeks (7E), each intended to cooperate with one of the flanges (7C) of said second part (7B), which carry means and components of the means (11) for controlling the feeding of the strip (6), including detachable means (23A, 24A, 25A) for coupling with complementary means (23B, 24B, 25B) carried by at least certain ends of the rollers (8, 9), of the mandrel (12) for winding the soiled strip, and of the reel (5) of the strip (6) of cleaning material in strip form.

7. A device according to claim 3, characterized in that it comprises at least:

an elongated part called a slider moving means (18), guided in translation on the frame (7) in a direction approximately perpendicular to the floor, which carries the support means (15) for support on the floor (2) at one of the ends of said means (18) and which receives, at the other end of said means (18), the action of the elastic means (16) for stressing said support means (15) for support on the floor (2) toward its so-called first position (15B), wheels (19E, 19F) with ratchets (19C, 19D), each at least indirectly linked to the mandrel (12) for receiving the soiled strip and to the heel roller (9) so as to drive, during their own rotation, these rollers (8, 9), a means (17), called a control lever, which is articulated to the frame (7) and disposed so as to receive an alternating movement from the slider moving means (18), and via a lever (19A) articulated to the frame (7), to move a pusher (19B) guided in translation on said frame (7) and carrying the ratchets (19C, 19D) for cooperating with the wheels (19E, 19F) for this purpose, a wheel (19H) at least indirectly linked in rotation to the nose roller (8) for rotationally immobilizing, during its own rotational immobilization, said nose roller (8), a driving means (19G) articulated to the frame so as to cooperate at least indirectly with the control lever means (17) and the wheel associated with the nose roller, so as to alternately, and in sync with the control of the fractional forward movement of the strip (6), rotationally immobilize the nose roller (8) and release this roller (8).

8. A device according to claim 5 or 6, characterized in that in order to constitute the means (28) for detachably joining the first (7A) and second (713) part of the frame (7):

at least one of the cheeks (7E) of the first part (7A) of the frame (7) is at least locally flexible in a plane approximately parallel to a plane (P1, P2) containing the axes of the rotating means (5, 8, 9, 12) carried by the second part (713) of the frame, and both the flanges (7C) of the second part (7B) and the cheeks (7E) of the first part are equipped with complementary projections and depressions, which are disposed so as to cooperate during the return to position of each cheek elastically deformed for the mounting of the second part of the frame.

* * * * *

UNITED STATES PATENT AND TRADEMARK OFFICE

CERTIFICATE OF CORRECTION

PATENT NO. : 6,223,378 B1
DATED : May 1, 2001
INVENTOR(S) : Christian Watellier

It is certified that error appears in the above-identified patent and that said Letters Patent is hereby corrected as shown below:

Column 7,
Line 15, delete “the” and insert -- a --.
Line 24, delete the first occurrence of “the” and insert -- a --.
Line 24, delete “being”.
Line 41, delete “the support means” and insert -- it --.
Line 64, after “(18)”, insert -- , associated with the support means (15), for support on the floor (2), and for rotationally driving means (19E), for controlling the rotation of the mandrel (12), for receiving the strip (6), --.
Line 66, replace “claim” with -- claims --.
Line 67, after “(11)”, insert -- , --.

Column 8,
Line 1, after “(17)”, insert -- , --.
Line 2, after “(18)”, insert -- , associated with the support means (15), for support on the floor (2), and for rotationally driving the driving means (19E), for controlling the rotation of the mandrel (12), for receiving the strip (6), --.
Line 9, delete “a” and insert -- the --.
Lines 16 and 17, delete “for controlling the flow”.
Line 21, delete “for alternately controlling”.
Line 43, delete “(8, 9)”.

Column 10,
Line 11, delete “6” and insert -- 7 --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,223,378 B1
DATED : May 1, 2001
INVENTOR(S) : Christian Watellier

It is certified that error appears in the above-identified patent and that said Letters Patent is hereby corrected as shown below:

This certificate supersedes Certificate of Correction issued November 19, 2002, the number was erroneously mentioned and should be vacated since no Certificate of Correction was granted.

Signed and Sealed this

Seventeenth Day of February, 2004

JON W. DUDAS
*Acting Director of the United States Patent and Trademark Office*